United States Patent [19]

Keska

[11] Patent Number: 4,638,999

[45] Date of Patent: Jan. 27, 1987

[54] CLIPS FOR BALANCING TILTABLE BOARD GAME

[75] Inventor: Tadeusz W. Keska, Warwick, R.I.

[73] Assignee: Jack B. Slimp, Jr., Manassas, Va.

[21] Appl. No.: 580,267

[22] Filed: Feb. 15, 1984

[51] Int. Cl.[4] ..... A63F 3/02; A63F 9/00

[52] U.S. Cl. ..... 273/258; 273/287; 273/288

[58] Field of Search ..... 272/146, 54, 55; 273/1 GF, 280, 287, 244, 247, 259, 148 R, 153 R

[56] References Cited

U.S. PATENT DOCUMENTS

| | | | |
|---|---|---|---|
| 889,562 | 6/1908 | Wagner | 272/54 |
| 1,193,994 | 8/1916 | Clayton | 272/54 |
| 1,550,040 | 8/1925 | Nagy | 272/54 |
| 3,224,777 | 12/1965 | Cirasunda | 273/148 R |
| 3,730,528 | 5/1973 | Corrado | 273/247 |
| 4,389,049 | 6/1983 | Wiley | 273/153 R |

FOREIGN PATENT DOCUMENTS

| | | | |
|---|---|---|---|
| 2008955 | 6/1979 | United Kingdom | 273/287 |
| 2052273 | 1/1981 | United Kingdom | 273/287 |

*Primary Examiner*—Richard C. Pinkham
*Assistant Examiner*—Benjamin Layno
*Attorney, Agent, or Firm*—Penrose Lucas Albright

[57] ABSTRACT

A balancing clip for a rectangular tilting game board with a central pair of axes coinciding with edges of projections which support the board above the underlying surface. The board is elevated to allow its tilting in either direction when the playing pieces thereon are unevenly distributed to cause a predetermined moment on one side or the other. The axes are located equal distances from the board's transverse centerline and are at the same level. The center of gravity of the combined board and playing pieces in their starting position and the axes are approximately at the same level. The longer sides of the board having depending edges or flanges with beads along their bottoms. The balancing clip has a resilient U-shaped part which resiliently grasps the flange on which it is received above the bead and is slidable along the flange to the position required to achieve the board's proper balance. The clip includes a weight part which extends normally relative to the flange under the board. Two clips are provided for the board. Each weighs three to four thousandths of the board's weight.

20 Claims, 30 Drawing Figures

FIG.5
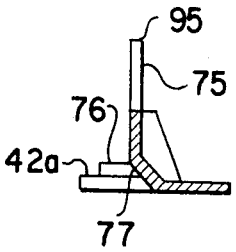
FIG.4
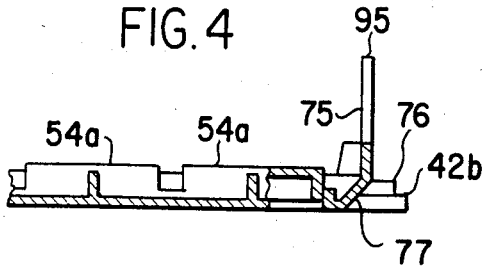
FIG.7
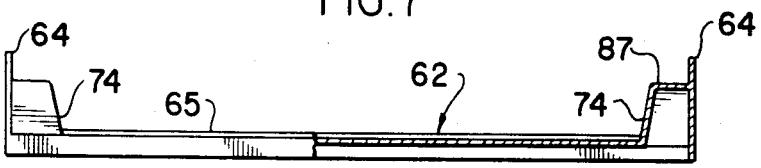
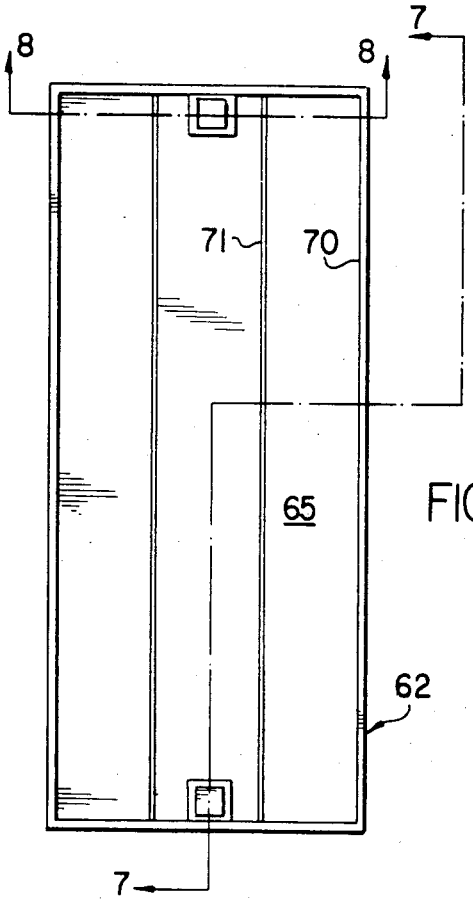
FIG.6
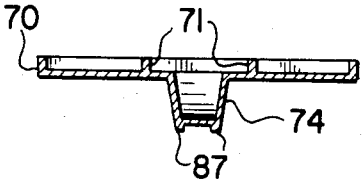
FIG.8

FIG. 10
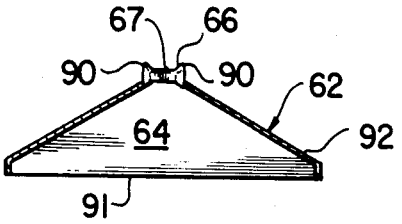
FIG. 9
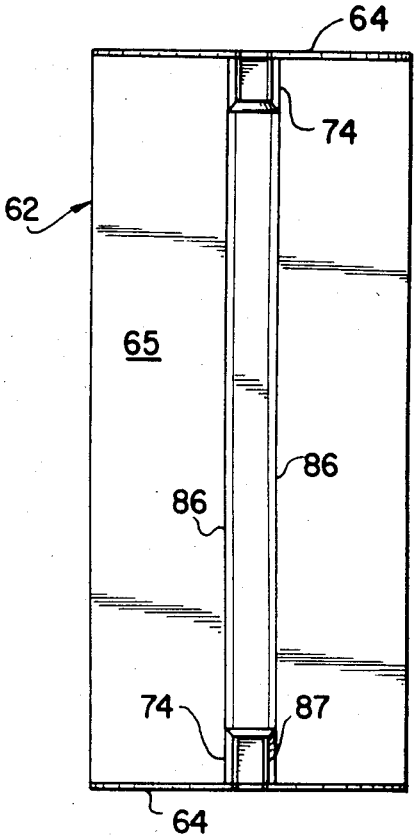
FIG. 11
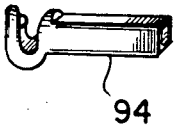
FIG. 12
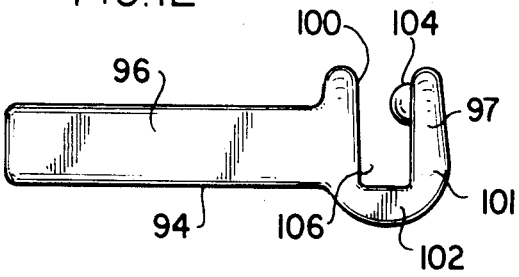
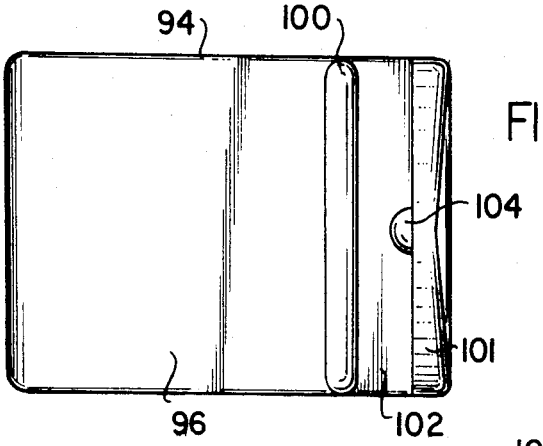
FIG. 13
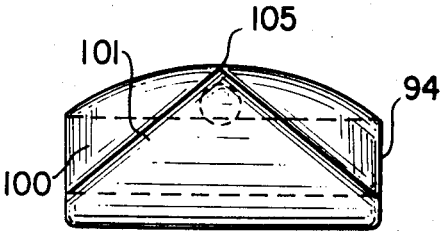
FIG. 14

18
19
23
24
54
55
57
60
107
108
110
111
112
114
115
51

CLIPS FOR BALANCING TILTABLE BOARD GAME

BACKGROUND OF THE INVENTION

This invention relates to game apparatus for a game which is controlled by the skill of the players. More particularly, it relates to a game device which includes a board which can be tilted by the movement and removal of pieces on the board and wherein means are provided to adjust the board's balance.

Games involving boards which tilt due to the movement of pieces along the game board have long been known. The following U.S. patents have issued on tilting games of various types:

| | |
|---|---|
| 479,683 | Truman |
| 562,264 | Wilcox |
| 596,089 | Patterson |
| 797,105 | Graves |
| 1,201,974 | Kohler |
| 1,215,033 | King |
| 2,458,306 | Schneider |
| 3,188,089 | Odell et al |
| 3,212,202 | Heinichen |
| 3,402,929 | Glass et al |
| 3,471,147 | Glass et al |
| 3,567,221 | Stultz |
| 3,613,268 | Fowler |
| 3,675,920 | Gorman |
| 3,618,949 | McLain |
| 3,764,134 | Reinertsen |
| 4,200,292 | Slimp |

Also the following British patents are of interest:

| | |
|---|---|
| 1,246,436 | Stultz |
| 1,322,100 | Glass |
| 1,502,969 | Harte |

Despite the above relatively large number of game devices which involve the maintaining of the equilibrium of the game board or causing same to tilt as part of the game play, such games have not previously achieved general popularity. This is true even though it would seem that maintaining the equilibrium of the game board as part of the game play should introduce an interesting further parameter into the game.

SUMMARY OF THE INVENTION

The primary purpose and object of the present invention is to ensure proper balance in a novel game apparatus which utilizes the equilibrium (or lack of equilibrium) of the game board as part of the game play wherein the competitive effort of the players depends entirely on their mental skill. Essentially the game is directed to a rectangular game board which is caused to tilt by the movement of pieces positioned within openings provided in the game board. The various playing pieces having different weights—three types of weighted pieces being utilized in the embodiment presented. The game play involves the alternate moving of the weighted pieces on the board by players until the board is caused to tilt one way or the other sufficiently to touch and come to rest upon the underlying surface, at which time a further weighted piece (several of which are provided along the outboard extremities of the playing board on each end, and are commonly referred to as point pieces or scoring pegs) is removed to restore the board to equilibrium. The object of the game is to fill an indicated portion of the board (on the opposite or distant side) with playing pieces when there are more weighted pieces (point pieces) removed from that side than the other side, or, to be first in filling the aforementioned outlined portion of the board (on the opposite side) when there is an equal amount of weighted pieces (point pieces) removed from each side. An important aspect of the game lies in the provision of two parallel axes (at equilibrium) which are also parallel to and on either side of an axis which passes through the center of gravity of the board and is perpendicular to the longer sides of same, such parallel axes both being positioned relative to the center of gravity of the board so that when the board is no longer in equilibrium due to the movement of weighted pieces, it (the board) will not balance in a non-horizontal position above the surface on which the board is supported but rather continues to tilt until the board touches such surface. At the same time, it is undesirable that the board be capable of assuming a tilted position with one end against the underlying surface if it does not automatically tilt to such position initially from in a horizontal position. Depressions for receiving playing pieces are in rows parallel to the foregoing parallel axes and are spaced equal distances apart. In order to ensure that within the tolerances of manufacturing processes the game board is properly balanced in an economical fashion, resilient plastic weight pieces are provided which are received by and slidable along edges of the board extending on either side of its axis. By positioning such pieces, exact balance of the board can be achieved prior to game play and for the purposes of such play.

Although the primary objective of the invention is to provide game apparatus as summarized above, other objects, adaptabilities and capabilities of the invention will appear as the description progresses, reference being had to the accompanying drawings, in which:

BRIEF DESCRIPTION OF THE DRAWINGS

FIG. 4 is a broken sectional view taken on lines 13—13 of FIG. 1;

FIG. 5 is a further broken sectional view taken on lines 14—14 of FIG. 1;

FIG. 6 is a bottom view of the fulcrum base for the board shown in FIGS. 1–5;

FIG. 7 is a sectional view taken on lines 15A—15A of FIG. 6;

FIG. 8 is a further sectional view taken on lines 15B—15B of FIG. 6;

FIG. 9 is a top plan view of the fulcrum base for the board shown in FIGS. 1–5;

FIG. 10 is a side elevational view of the fulcrum base;

FIG. 11 is a perspective view of a balance clip in accordance with the invention used with the board shown in FIGS. 1–5;

FIG. 12 is a side elevational view of the balance clip shown in FIG. 11;

FIG. 13 is a plan view of the balance clip shown in FIGS. 11 and 12;

FIG. 14 is a front elevational view of the balance clip shown in FIGS. 11–13;

DESCRIPTION OF THE PREFERRED EMBODIMENT

FIGS. 1–30 are directed to a current recently introduced commercial model. An important aspect of the invention concerns the balancing clips which are adapted to be received by an edge of the board and moved along same to adjust the balance.

Figure 1:
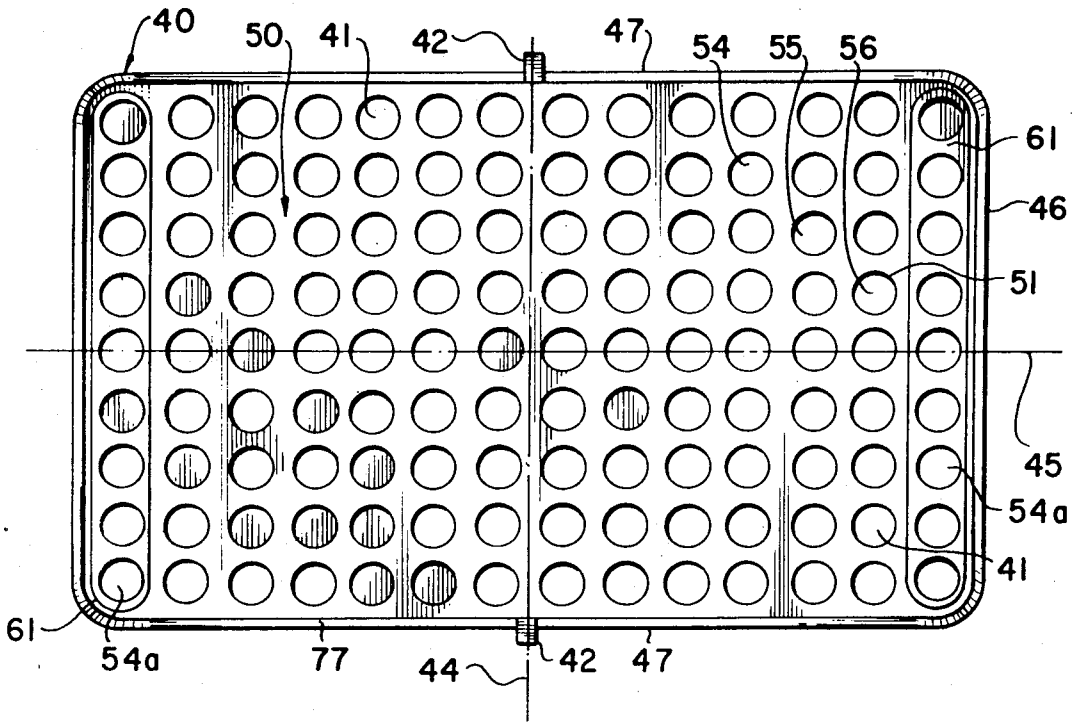
FIG. 1 is a plan view of a modified game board for use with the invention.

Referring now to FIGS. 1–5, a rectangular game board 40 is shown which has circular indentations or depressions 41 for receiving the playing pieces and the point pieces. It includes two integral projections 42 which define a pair of central parallel axes 42*a* and 42*b* which are equidistance from a central axis 44 of the game apparatus balanced and positioned to commence game play. Axis 44 is through the center of the board perpendicular to its longer sides and represents the center of gravity of the board and any playing or point pieces thereon when positioned to commence game play. In other words, it constitutes an imaginary axis perpendicular to the board's longer sides 47 and parallel to its surface about which the board and playing pieces in their starting position (assuming they would not fall off) would freely rotate. Thus axis 44 moves as the disposition of the pieces are changed. A longitudinal centerline 45 is also shown which extends longitudinally through board 40 and is perpendicular to its shorter sides. The board parts on each side of central axis 44 and of centerline 45 respectively as shown in FIG. 1 are identical. Axes 41*a* and 41*b* comprise the lower corners of protections 42. They are parallel to the shorter sides 46 and perpendicular to the longer sides 47 of board 40.

In board 40, on each side of axis 44 there are seven rows of depressions 41, each such row being parallel to axes 42*a*, 42*b* and 44. Each such row has nine depressions 41. A trapezoid shaped safety zone 50 is indicated by the presence of raised rims 51 (shown by thicker lines in FIG. 1) around depressions 41 which are in safety zone 50.

Whereas depressions 41 are located in fourteen rows parallel to shorter sides 46, they are also arranged in nine columns parallel to longer sides 47. With this arrangement board 40 has one hundred, twenty-six depressions arranged nine across and fourteen lengthwise. Each depression 41 may be occupied by a playing piece 54, 55 or 56 the starting positions for rows in zones 50 being indicated by reference numerals 54, 55 and 56 in FIG. 1 and 3 (see also FIGS. 15–29 for the playing pieces per se). The three categories of playing pieces are small playing pieces 54, medium playing pieces 55, and large playing pieces 56. Each such playing piece is integral, that is, it constitutes a unit of continuous material without attached or bonded parts, and includes an upright grasping portion 57 and a base 60. The latter has a diameter slightly less than each depression 41 so that each base 60 is vertically slidable into and from each depression 41 and at the same time is relatively closely received and retained therein.

The row of depressions 41 adjacent each shorter side 46 are defined in a shallow elongated inset part 61. They receive scoring pegs, also referred to as point pieces 54*a*, which are identical to playing pieces 54 except they are of a different color, positions of same indicated by reference numeral 54*a* in FIGS. 1–3. The other playing pieces (which are of a different color for each side) may also be referred to as combat pieces.

The weight of each playing piece (and scoring peg) 54 is 33.6 grams; of each playing piece 55 is 44.3 grams; and of each playing piece 56 is 56.3 grams, within about two percent accuracy. Thus, playing pieces 54, 55, 56 have a ratio of 1:1.32:1.68. All parts are made of high impact styrene plastic. The board weighs 195.6 grams.

Referring now to FIGS. 6–10, the fulcrum base 62 has a longer dimension corresponding to that between the outer ends of projections 42 and has a configuration of a shallow U. It comprises a pair of identical upright legs 64 separated by a horizontal connecting web 65 as seen in FIG. 15A. Legs 64 define at their top, a dip or notch 66 with a flat surface 67 to receive projections 42. Web 65 includes supporting ribs 70 and interior ribs 71 which serve to stiffen and brace same. With playing pieces on the board, axes 42*a* and 42*b* are approximately at the same level as the horizontal transverse central axis 44. Such axis, as indicated above, is that centerline perpendicular to sides 47 and parallel to the surface of the board which would constitute the static or dynamic center of gravity for the board if it could be rotated around such centerline with the playing pieces (including the point pieces) being firmly retained in their respective positions in depressions 41. Its position relative to axes 42*a* and 42*b* is critical. If too low, the board will tilt in play, but will not necessarily, once it has started tilting, continue to tilt until it hits the surface of the underlying table or whatever is being utilized as the surface for the fulcrum base 62. If it is too high, the board can be tilted (without movement of playing pieces) to the underlying surface where it remains, whereas, when level it will not commence to make such a tilt. Moreover, with axes 42*a* and 42*b* correctly positioned near or at the level of axis 44, the underlying surface for the fulcrum base 62 need not be absolutely horizontal (albeit it should be substantially horizontal)

and the play of the game is not adversely affected. Because pieces are removed from the playing board during play, the centerline or central axis 44 moves not only either towards one side 46 or the other, but also slightly downwardly. The position of axes 42*a* and 42*b* is, of course, fixed. Therefore, preferably at the start of play with the playing pieces and point pieces in place, axis 44 may be very slightly above the level of axes 42*a* and 42*b*. With the game, and its typical ending phase, centerline 44 is preferably at a level at worst even with or only slightly higher than that of axes 42*a* and 42*b*. Contributing to this favorable result is the circumstance that the center of gravity of each individual playing piece and point piece has been lowered relative to axis 44 by being received in depressions 41. Thus, in the instant embodiment the proportion of each piece which is lower than the center of gravity of axis 44 is substantial.

Figure 2:
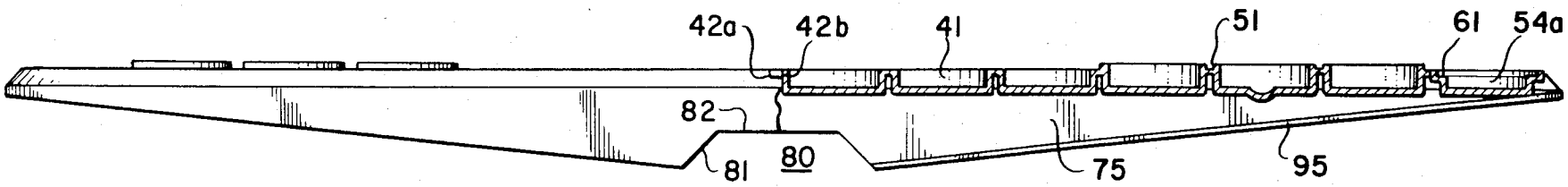
FIG. 2 is a sectional view of the game board shown in FIG. 1 taken on section lines 11—11.
Figure 3:
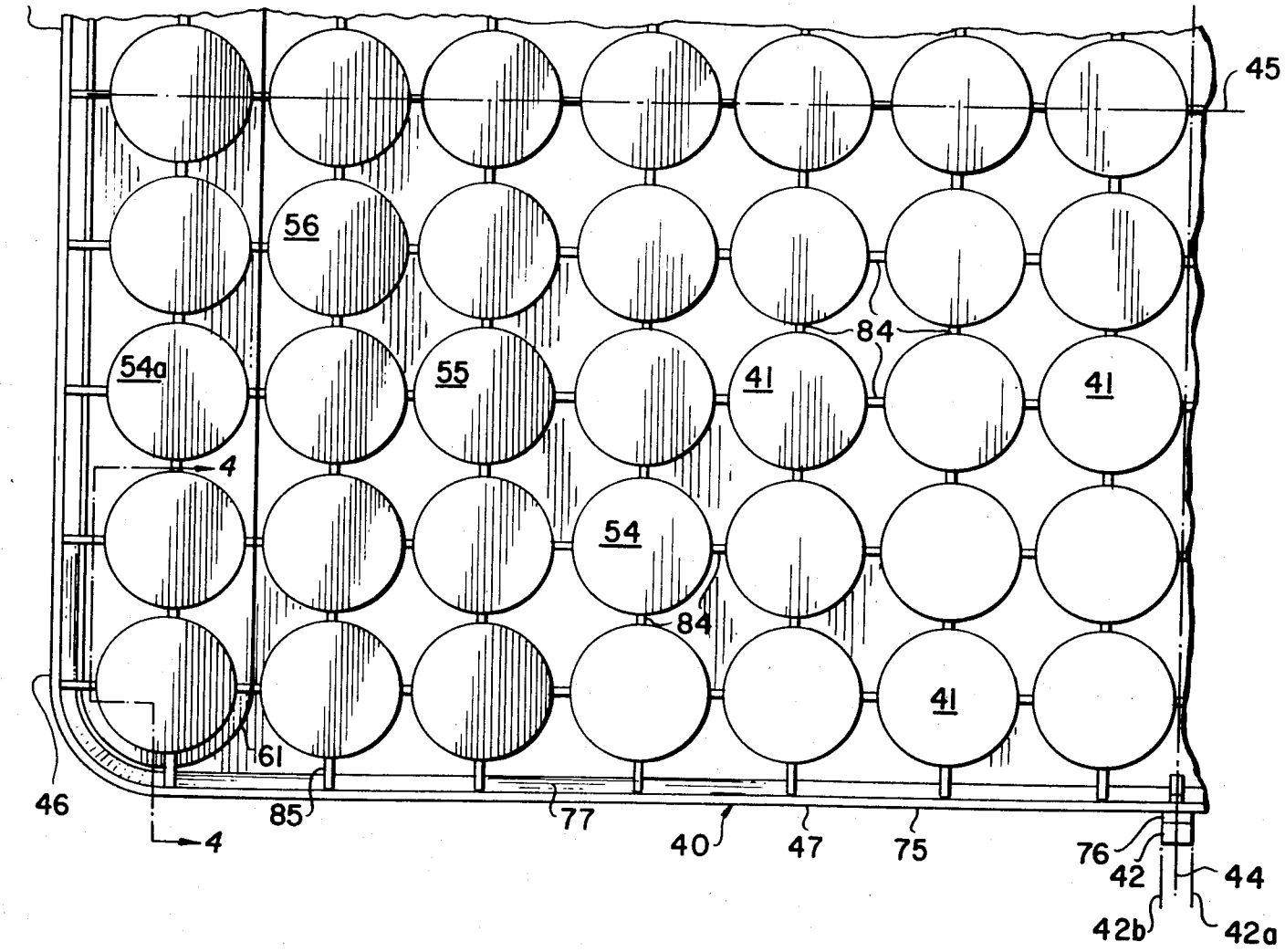
FIG. 3 is a broken bottom view of one quarter of the game board shown in FIGS. 1 and 2.

Fulcrum base 62 is provided with stiffening trapezohedrons 74 which retain legs 64 generally rigidly at a 90 degree angle to web 65. Referring to FIG. 2, the vertical sides of flanges 75 which depend from sides 47 of board 40 are disposed, with board 40 properly received by fulcrum base 62, parallel to and inboard of legs 64. On the lower side of each projection (between 42*a* and 42*b*) is a centering tab 76 which abuts against the inboard surfaces of legs 64 immediately under flat surfaces 67 of dips 66. This abutment between tab 76 and leg 64 is, however, a loose one permitting a play of 1/32nds of an inch in a transverse direction. The width of flat surface 67 is substantially greater than the distance between the axes 42*a* and 42*b* and therefore certain movement or play is also possible in the longitudinal direction parallel to centerline 45.

The starting row positions of the various playing pieces 54, 55 and 56 in depressions 41 in zone 50 defined by rims 51 is indicated in FIG. 1. The reference characters 54*a* indicate the row for receiving the nine scoring pegs in depressions 41 surrounded by each inset part 61.

Board 40 is rounded at the corners and the upper edges are provided with a 45 degree bevel 77. Flanges 75 have on each longer side 47 a centrally disposed upwardly extending notch 80 which is defined by edges 81 joined by horizontal edge 82, edges 81 being at right angles to each other and 45 degrees to the horizontal. Their imaginary lineal extensions intercept at approximately the center of tab 76. From the downward termination of edges 81, flange 75 tapers in a straight line, upwardly at a slight inclination (about 5 degrees) to 0.125 inches under bevel 77 where it extends around the curve and along side 46. Thus flanges 75 may be considered a continuous flange which extends completely around board 40 under bevel 77 which is discontinuous, being interrupted only by projections 42 and tabs 76.

Depressions 41 are, as seen from the bottom of board 40 in FIG. 12, protrusions 41 and are joined on four sides by ribs 84. The outermost rows and columns of such protrusions 41 are joined by further ribs 85 to bevel 77. Ribs 84 and 85 together with depressions-protrusions 41, flange 75, bevel 77 and the upper surface of board 40, provide a substantially rigid structure.

The thickness of the material for the game board is 0.06 inches. Depressions 41 have interior diameters of 0.75 inches and the overall diameter of the circles defined by the outside dimensions of rim 51 is 0.875 inches. Each row of depressions 41 is spaced from the adjacent row from the vertical centerline of the corresponding depression 41 in the next row by one inch. In the same manner, adjacent columns are also one inch apart, center to center. The width of each row, each having nine depressions, from the outermost center to outermost center is thus eight inches and the length of each column from the centerline of the outermost depression to the centerline of the opposite outermost depression is thirteen inches. Projections 42 having width measured parallel to sides 47 of 0.16 inches and, as seen in FIG. 1, they extend from sides 47, 0.2 inches. Centering tabs 76 protrude 0.08 inches. Ribs 51 extend upwardly from the surrounding surface 0.04 inches and depressions 41 are 0.175 inches deep. Inset part 61 is depressed 0.05 inches. The vertical height along sides 46 of flange 75 and bevel 77 is 0.3 inches. Bevel 77 as seen in FIGS. 10 has a width of 0.2 inches. Each projection 42 is 0.08 inches in thickness. Each rim 51 is 0.06 inches in thickness and its vertical dimension measured from the upper surface of the playing board is 0.04 inches. In depressions 41, the 0.75 inch diameter is that as measured along the bottom of the depression. It is slightly wider at the top inasmuch as the edges of the depression 41 diverge upwardly at two degrees.

Board 40 has a width, from side 47 to opposite side 47, of 9.5 inches and its length, from side 46 to opposite side 46, is 14.5 inches. Its weight is about 6.9 ounces or, as noted previously, 195.6 grams.

Referring to fulcrum base 62 shown in FIGS. 6–10 it will be noted the top of web 65 is provided with two longitudinal ridges 86 which are, across their outboard sides, the same width as trapezohedrons 74. On top of trapezohedrons 74 there are a further pair of shorter ridges 87 which are approximately the same distance apart as extensions 90 which define dip 66. The overall width of surface 67, measured parallel to legs 64, is 0.312 inches. The overall width between the outboard sides of extensions 90 is 0.453 inches. From surfaces 67, dip 66, which is defined between extensions 90, diverges from the vertical on each side by twenty degrees and on the opposite side by about twenty degrees. The height of surface 67 above the bottom 91 of leg 64 is 1.32 inches. Extensions 90 are each 0.08 inches in height. The height of trapezohedrons 74 relative to bottom 91 is 0.8 inches and the height of each ridge 87 is 0.08 inches. The upper profiles of trapezohedrons 74 including ridges 87 as shown in FIG. 8 are essentially the same as the profiles of dips 66 as seen from the side. The top of web 65 is retained 0.25 inches above the underlying surface and ribs 70 therefore also have a vertical dimension of 0.25 inches and have continuous insets on their inboard lower sides which have horizontal depths of 0.03 inches and heights of 0.05 inches. Web 65 is four inches wide and 9.7 inches long overall. Each leg 64 has along its upper edge including at and immediately under extensions 90, a bead 92 which is 0.08 inches in thickness in depth around both ends. The remainder of each leg 64 is 0.06 inches thick. Ridges 86 on the top of web 65 are 0.06 inches in height and the longer dimensions of trapezohedrons 74 at its top, parallel to ribs 70 and 71, are each 0.482 inches. The three sides of trapezohedrons 74, not including the side defined by adjoining leg 64, are all inclined upwardly at 10 degrees. The thickness of web 65 is 0.04 inches. Bottom ribs 71 are also 0.04 inches thick and are 1.28 inches apart inboard side to inboard side.

FIGS. 11–14 are directed to a means for adjusting the balance of board 40 comprising a resilient balance clip 94 which is receivable on the inclined portion of flange 75 along side 47. For this purpose, flange 75 is provided on its lower aspect with a shallow bead 95 parallel to its lower edge which extends upwardly less than 0.1 inches (actually about 0.06 inches) and outwardly from the outer face of flange 75 along the inclined part shown in FIG. 11 not more than 0.05 inches (in fact, about 0.02 inches). Balance clip 94 weighs about 0.024 oz. Preferably its mass compared to that of board 40 is small; about three to four thousandths of same has been found to be an advantageous ratio. It comprises a weight part 96 of rectangular cross section and a clip part 97. The latter part is U-shaped with the inboard leg thereof comprising a backing seat 100, the outboard leg thereof comprising a clamping portion 101, such legs being joined by an arcurate connecting portion 102 which integrally connects one such leg, seat 100 to the other which comprises clamping portion 101. On the interior of clamping portion 101 is a convex protrusion comprising a hemisphere portion 104. It will be noted from FIG. 14, clamping portion 101 terminates on its upper side or aspect at a point 105 which is immediately above and centered relative to hemisphere portion 104. Thus, backing seat 100, connecting portion 102 and clamping portion 101 define a slot 106 adapted to receive bead 95 and which is resiliently received therein by bending or forcing clamping portion 101 slightly outwardly on inserting clip 94 on bead 95 which is received in the wider lower aspect of slot 106 with it thinner aspect of hemisphere portion 104 being above bead 95. It is then held in place by the resilient clamping action of hemisphere portion 104 against the sides of flange 75 above bead 95 and backing seat 100. Weight part 96 is then located under board 40 and point 105 is directed upwardly. Clip 94 can be slid along bead 95 to a position as may be required to achieve the exact required balance of board 40 on fulcrum base 62.

Two clips 94 are provided with each game and may be placed on each side or both on one side of notch 80 where they are slidable in either direction along flange 75 relative to sides 47. Weight part 96 is 0.125 inches in thickness as seen in FIG. 12 and 0.5 inches in width as seen in FIG. 13. When clip 94 is received in flange 75, weight part 96 projects under board 40. The overall length of clip 94 is 0.7 inches. Slot 106 is 0.08 inches in width and from its top to the horizontal centerline of hemisphere portion 106 is 0.05 inches. The upward ridge of backing seat 100 is 0.06 inches high proximate point 105 as seen in FIG. 14 and extends 0.55 inches above the centerline of hemisphere portion 104. Clamping portion 101 is 0.06 inches at its thickest and tapers upwardly and inwardly therefrom at a five degree angle. The outer lower surface of connecting portion 102 follows a 0.1 inch radius centered in slot 106, 0.04 inches above its bottom. As seen in FIG. 14, the upward ridge of backing seat 100 coincides with an arc, its radius being 0.518 inches. Clip 94 may also be received on the lower edges of sides 46.

Figures 15, 16, 17, 18, 19, 20, 21, 22, 23, 24:
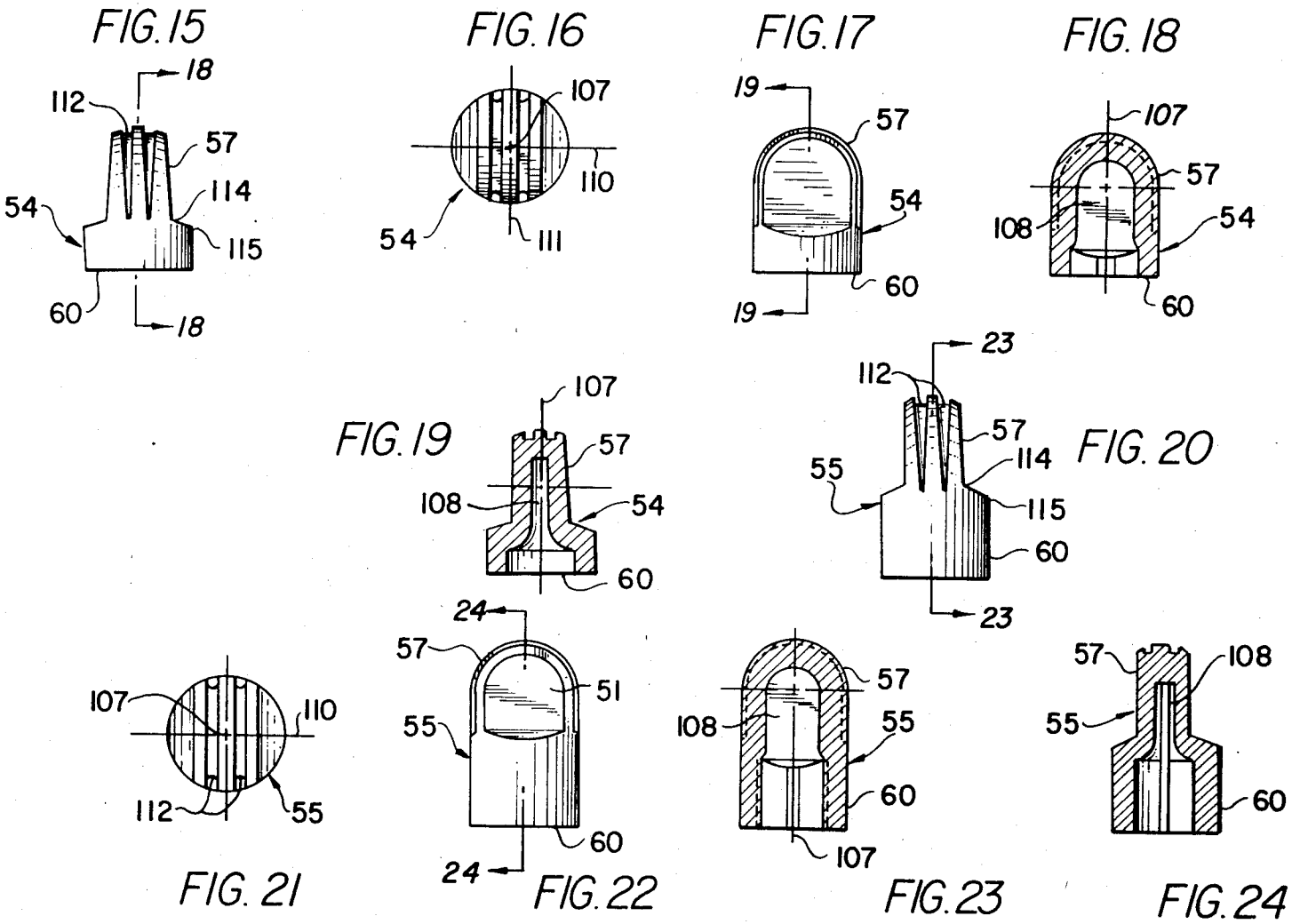
FIG. 15 is a side elevational view of a small playing piece (or point piece) for the game board shown in FIGS. 1–5.
FIG. 16 is a plan view of a playing piece shown in FIG. 15.
FIG. 17 is a front elevational view of the playing piece shown in FIGS. 15 and 16.
FIG. 18 is a sectional view taken on lines 25—25 of FIG. 15.
FIG. 19 is a sectional view taken on lines 26—26 of FIG. 17.
FIG. 20 is a side elevational view of a medium playing piece for the game board shown in FIGS. 1–5.
FIG. 21 is a plan view of the playing piece shown in FIG. 20.
FIG. 22 is a front elevational view of the playing piece shown in FIGS. 20 and 21.
FIG. 23 is a sectional view taken on lines 30—30 of FIG. 20.
FIG. 24 is a sectional view taken on lines 31—31 of FIG. 22.
Figure 26:
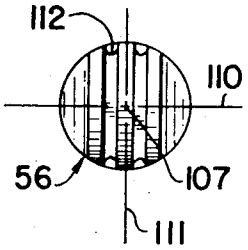
FIG. 26 is a plan view of the playing piece shown in FIG. 25.

Referring to FIGS. 15–29, playing pieces 54, 55 and 56 (as well as point piece **54*a* which is identical except for color with playing piece 54) have much the same structure except for the length of base 60. As seen in FIG. 16, a longitudinal centerline 107 for piece 54 is the intersection of imaginary planes 110 and 111 disposed 90 degrees apart. Plane 111 bisects the playing piece 54 whereby one side is a mirror image of, and at the same time, identical to the other side. The same is true of the parts which would be created by cutting through playing piece 54 along plane 110. Thus the center of gravity of playing piece 54, when level, falls somewhere on centerline 107 irrespective of the position of the playing piece 54 on board 40. This is also true with respect to playing pieces 55 and 56. Each side starts with nine point pieces 54*a*, seven playing pieces 54, five playing pieces 55 and three playing pieces 56 received in depressions 41 of the respective rows indicated by such reference numerals and thicker lined rims in FIG. 1**.

Figure 29:
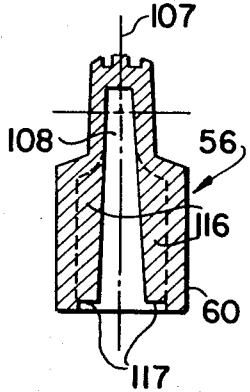
FIG. 29 is a sectional view taken on lines 36—36 of FIG. 27.
Figure 28:
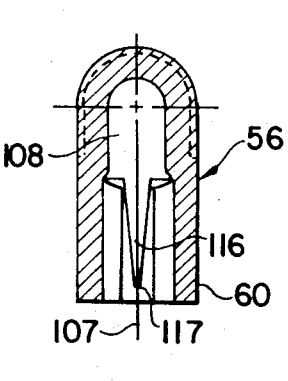
FIG. 28 is a sectional view taken on lines 35—35 of FIG. 25.
Figure 30:
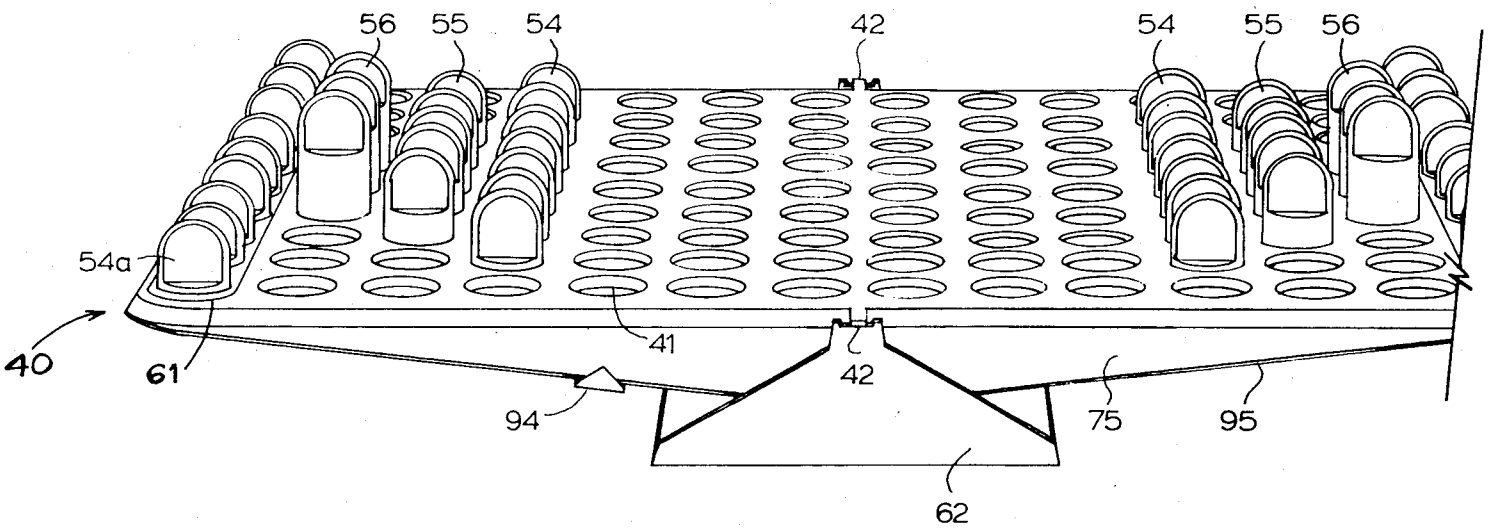
FIG. 30 is a perspective view showing the components of the game ready to commence game play.

The outermost upper surface of grasping portion 57 coincides in part with a spherical surface of 0.36 inch radius, there being two inboard grooves 112 of 0.31 inches radii. The overall diameter of playing piece 54 is 0.735 inches. The shorter width of the grasping portion 57 is 0.42 inches and its longer dimension parallel to plane 111 is the full width of 0.735 inches. The height of each playing piece 54 is 0.99 inches and for grasping portion 57, it is 0.675 inches from point 114 in FIG. 15. The shelf extending therefrom is inclined downwardly from the horizontal at fifteen degrees. The height of the base from point 115, as seen in FIG. 15, is 0.266 inches. The material thickness for the grasping portions 57 for both pieces 54 and 55 is 0.125 inches. For playing piece 56, however, this thickness is, as seen in FIG. 29, 0.095 inches. Otherwise the grasping portions 57 for playing pieces 54, 55 and 56 are identical.

Figure 27:
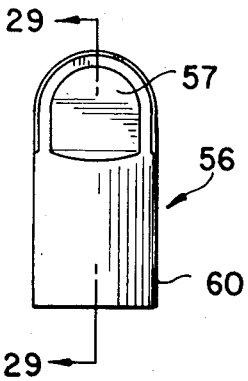
FIG. 27 is a front elevational view of the playing piece shown in FIGS. 25 and 26.
Figure 25:
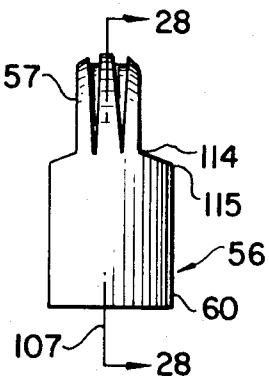
FIG. 25 is a side elevational view of a large playing piece of the game board shown in FIGS. 1–5.

For playing pieces 54 and 55, the base portions 60 are also identical except that the base 60 of playing piece 55 has a height of 0.546 inches from its bottom to point 115 in FIG. 27. The overall height of playing piece 55 is 1.27 inches.

Base 60 in playing piece 56 has a height from its bottom to point 115 (FIG. 25) of 0.826 inches. As indicated above, its sides in grasping part 57 as shown in FIG. 29 are 0.095 inches in thickness thus making the internal slot 108 somewhat wider along its dimension parallel to plane 110. It also has in base 60 a pair of interior facing ribs 116 which are at their upper dimension as seen in FIG. 35, 0.09 inches in thickness and which taper to a curved lower part 117 elevated 0.09 inches above the bottom of piece 56. By increasing the width of slot 108 and adding ribs 116, the center of gravity of each large playing piece 56 is lowered.

For game play, balance clips 94 are employed first to achieve desired balance. This is obtained by placing and sliding one or both of the balance clips 94 along the bottom of flange 75 as required whereby when a point piece or one of the small pieces is placed in the third row from the end of each shorter side 46, board 40 is on the verge of tipping. This is accomplished by first placing a small piece in the third from the end row on one side and then on the other to achieve the desired balance. With only one small playing piece, it will be appreciated that the center of gravity or in other words, centerline or central axis 44 is lower relative to axes **42*a* and 42*b* than when all the playing pieces are on board 40. Clips 94 are necessary to ensure board 40 is properly balanced for game play. Due to modifications in manufacturing, some adjustment of the board's center gravity is almost always requisite and clips 94** provide allowance for this deficiency.

Next all playing pieces including the point pieces are positioned as described with reference to FIG. 1 and one end of the game board 40 is held down so it rests on the underlying table surface. It is then released and the board should rock evenly. If one end appears heavier than the other and the board rocks unevenly, balance clips 94 are then adjusted further to achieve an exact balance of game board 40 for game play.

The play of the game will now be described. Basically, a player moves his pieces 54, 55 and 56 out of his safety zone 50, where they are located before play begins, and towards the opponent's safety zone 50. The prime objective on all plays is to upset the balance and tip game board 40 down on the opponent's side. Each player is allowed to move only his own color playing pieces and to move only one of such playing pieces each turn. The pieces can move in any direction, transverse, longitudinally or diagonally. They can, however, only move to vacant spaces, in other words to depressions 41. Players may make either simple single moves, moving a piece 54, 55 or 56 to an adjacent empty space, or may make multiple moves, moving one of their respective pieces more than one adjacent space by jumping over other pieces, either his or his opponent's. When making a multiple move, that is in jumping over an enemy, the enemy piece is captured and removed from the board if it is a large or medium playing piece and has been jumped by a small or medium playing piece. A player does not capture his own pieces by jumping them and in a multiple move may jump his same piece two or more times. A playing piece can only jump one piece (his own or the opponent's) at a time, but can continue doing so for more than a single jump in one move. Thus jumping must be to a vacant space and only one piece may be jumped in each hop in a multiple move. Jumping is always optional. Playing pieces 54, 55 and 56 are never moved into the end rows where the point pieces 54*a* are located and point pieces 54*a* are never moved into the other rows. Playing pieces in a safety zone 50 cannot be captured.

Play is continued until a playing piece upsets the balance and the board tilts. Generally, the board is held horizontal by hand while a move is being made and the hand is then removed to determine whether the board tilts. Irrespective of who made the move, the player is penalized when side 46 tilts down on his side. Then, to balance the board, one or more of the original point pieces are removed from the downside as necessary. A player loses when he runs out of point pieces or if a player moves all of his remaining playing pieces into the opponent's safety zone while having more scoring pegs (point pieces) in his side 46 than the opponent's side 46. If both sides have the same remaining number of point pieces in their respective sides 46, then the first to move all of his playing pieces into the opponent's safety zone wins.

The strategy of the game is to tip the balance of board 40 down on the opponent's side as often as possible. There are two basic tactics to accomplish this. Either the player avoids capture as well as he can by keeping his force intact as he moves into enemy territory, or alternatively, he can sacrifice capturable pieces quickly so that he can move into enemy territory with a small, swift force to trap the opponent's heavyweight pieces there. For both tactical approaches, however, the aim is to concentrate the weight on the opponent's side so the game board 40 tilts toward the opponent.

The criticality of properly positioning axes 42 and 42*a* has been found difficult for many to understand without detailed explanation and demonstration. But, it is to be emphasized the game does not play correctly unless the board, once it starts to tip, continues to tip until it reaches the underlying surface and, also importantly, vice versa. Thus if board touches the underlying surface in a tipped position, it should not be possible to level the board without removing a point piece. If the nature of the balancing is otherwise, an unsatisfactory ambiguity is introduced into the game. It is for this reason, axes 42*a* and 42*b* are preferably maintained at very closely the same level as the board's center of gravity as represented by axis 44. Axis 44 is movable relative to axes 42*a* and 42*b* not only from side to side, but also is lowered somewhat as the game progresses with the removal of captured pieces of point pieces. This is ameliorated to some degree by the game rules which provide the more numerous small pieces cannot be removed from the board and large pieces 54 cannot capture other pieces. Also if the game is well played, neither side removes all its point pieces. This tends to minimize changes in the level of the axis 44 and retain same within permissible limits without adversely effecting the strategy of the game. Providing depressions 41 and lowering the relative center of gravity of large pieces 56 also mitigates variations in the vertical disposition of movable axis 44 relative to fixed axes 42*a* and 42*b*.

It will be evident to those skilled in the art that the drawings (FIGS. 1–30) are insofar as practicable drawn to scale.

Although I have disclosed the preferred embodiments of my invention in the foregoing specification and drawings, it is to be understood that the inventive concepts incorporated therein may be embodied in other adaptations and modifications within the scope of the appended claims.

Having described my invention, what I claim as new and to be secured by Letters Patent of the United States is:

1. An improvement in an amusement device which comprises a generally coplanar rectangular board that has a central balancing axis which divides the board into two opposite portions, a plurality of playing pieces for said board, and means integral with said board for supporting and balancing said board above an underlying surface together with said playing pieces thereon in position to start game play, said board having downwardly extending edges along its sides from said supporting and balancing means, wherein the improvement comprises balancing adjustment means slidably and selectively received on one of said edges, each said edge having a uniform cross-section including a thinner portion which is farther away from the bottom of said edge than a thicker portion adjacent same, said balancing adjustment means comprising U-shaped grasping means adapted to bear resiliently on both sides of said thinner portion and a weight portion extending normally outwardly from said grasping means and substantially horizontally away from said edge, said grasping means surrounding said thicker portion and being slidable along said thinner portion to move the center of gravity of said board in its direction of movement and to adjust same so that said board tilts about said supporting and balancing means upon application of the same moment on either side of said central balancing axis.

2. An improved amusement device in accordance with claim 1 wherein said weight portion is at all times, when said board is in balance, maintained at a relatively lower level than said supporting and balancing means.

3. An improved amusement device in accordance with claim 1 wherein said edges are disposed substantially vertically.

4. An improved amusement device in accordance with claim 3 wherein grasping means includes legs and said weight portion extends normally from said legs of said grasping means.

5. An improved amusement device in accordance with claim 4 wherein said weight portion extends generally in an inboard direction, the outboard leg of said grasping means having a hemisphere portion which bears on said thinner portion.

6. An improved amusement device in accordance with claim 5 wherein the inboard leg of said grasping means comprises a backing seat, said weight portion extending from said backing seat in a direction opposite from where said backing seat bears against said edge.

7. An improved amusement device in accordance with claim 1 wherein the weight of said balancing adjustment means is in a range of 0.003 to 0.004 of the weight of said board.

8. An improved amusement device in accordance with claim 1 wherein said edge is inclined from the center of said board upwardly relative to the top of said board.

9. An improved amusement device in accordance with claim 8 wherein said inclination is about five degrees.

10. An improved amusement device in accordance with claim 1 wherein a further like balancing adjustment means is slidably received on one of said edges.

11. An improved amusement device in accordance with claim 1 wherein said board and said balancing adjustment means are composed of high impact styrene plastic.

12. In a game which includes a game board which tilts about projections extending from the board, means to adjust the balance of the board relative to said projections which comprises a pair of depending vertically disposed edges on the board extending generally horizontally and normally relative to said projections, said edges each having a relatively thin thickness relative to their vertical dimensions and a bead along their lower aspects, the means to adjust the balance of the board comprising U-shaped resilient clip means which is resiliently received by and bears on one of said edges above said bead and is slidable along such edge above said bead, said clip including a slot into which said one edge is received and which has a vertical dimension substantially longer than its horizontal dimension across said slot.

13. The combination of claim 12 wherein said clip is composed of high impact styrene plastic.

14. The combination of claim 12 wherein said clip means defines a slot which receives said edge, said slot being thinner at its upper aspect above said bead than at its lower aspect.

15. The combination of claim 14 wherein a portion of said clip means adjacent to the upper aspect of said slot is convex.

16. The combination of claim 12 wherein said edges are generally lower than said projections and are inclined relative to the surface of the game board by not more than about five degrees.

17. The combination of claim 16 wherein said edges extend from adjacent said projections to adjacent the outer ends of said board.

18. A game which includes a game board which in game play may tilt from a horizontal position about a central support so that either end touches the underlying surface and wherein the game board includes a lower edge, in combination with means for balancing the board before commencing play which comprises a clip which is adapted to be received on said lower edge and be moved along said edge wherein said edge has a relatively thin thickness relative to its vertical dimensions, and said clip includes a slot into which said edge is received and which has a vertical dimension substantially longer than its horizontal dimension across said slot.

19. The subject matter of claim 18 wherein said edge has a bead along its lower aspect and said clip comprises a resilient material surrounding a slot which receives said edge, said resilient material bearing on said edge above said bead.

20. In a game which includes a game board which tilts about projections extending from the board, means to adjust the balance of the board relative to said projections which comprises a pair of depending vertically disposed edges on the board extending generally horizontally and normally relative to said projections, said edges having a bead along their lower aspects, and means to adjust the balance of the board comprising U-shaped resilient clip means which is resiliently received by and bears on one of said edges above said bead and is slidable along said edge above said bead, said edges being generally lower than said projections and being inclined relative to the surface of the game board by not more than about 5°.

* * * * *